US005167120A

United States Patent [19]

Junginger et al.

[11] Patent Number: 5,167,120

[45] Date of Patent: Dec. 1, 1992

[54] METHOD OF CONTROLLING THE TEMPERATURE OF AN EXHAUST GAS PROBE

[75] Inventors: Erich Junginger, Stuttgart; Lothar Raff, Remseck; Eberhard Schnaibel, Hemmingen, all of Fed. Rep. of Germany

[73] Assignee: Robert Bosch GmbH, Stuttgart, Fed. Rep. of Germany

[21] Appl. No.: 840,817

[22] Filed: Feb. 25, 1992

[30] Foreign Application Priority Data

Mar. 1, 1991 [DE] Fed. Rep. of Germany ..... 4106541

[51] Int. Cl.[5] ..... F01N 3/20

[52] U.S. Cl. ..... 60/274; 60/276; 123/688; 123/697

[58] Field of Search ..... 60/274, 276; 123/688, 123/697

[56] References Cited

U.S. PATENT DOCUMENTS 4,007,589 2/1977 Neidhard et al. .
4,291,572 9/1981 Maurer et al. .
4,294,679 10/1981 Maurer et al. .
4,993,392 2/1991 Tanaka ..... 123/697
5,101,625 4/1992 Sugino ..... 60/276

FOREIGN PATENT DOCUMENTS 0067437 12/1982 European Pat. Off. .
3326576 6/1984 Fed. Rep. of Germany .

*Primary Examiner*—Douglas Hart
*Attorney, Agent, or Firm*—Walter Ottesen

[57] ABSTRACT

The invention is directed to a method for the temperature open-loop control and closed-loop control of exhaust gas probes for mixture control systems having several heatable exhaust gas probes. For this purpose, the temperature of one exhaust gas probe is closed-loop controlled in a control loop and the heaters of other exhaust gas probes are open-loop controlled. The closed-loop controlled exhaust gas probe controls the open-loop controlled exhaust gas probes insofar as the actuating variable of the temperature control loop is used as the output value for the temperature open-loop control of the other exhaust gas probes.

11 Claims, 2 Drawing Sheets

METHOD OF CONTROLLING THE TEMPERATURE OF AN EXHAUST GAS PROBE

FIELD OF THE INVENTION

The invention relates to a method for the closed-loop or open-loop control of the temperature of an exhaust gas probe for an internal combustion engine.

BACKGROUND OF THE INVENTION

Exhaust gas probes have output signals which fluctuate in dependence upon the oxygen content of the exhaust gas. It has long been known to use such probes as control sensors for controlling the mixture of an internal combustion engine. However, this is only possible if the exhaust gas probe is adequately heated because of the pronounced temperature dependency of the probe signal. The heat necessary to reach this temperature is at least partially supplied to the probe by the exhaust gases of the engine. The heat energy supplied in this manner can however be inadequate because of an unfavorable location of installation of the probe or because of the operation of the engine at a load which is too low. It has therefore been shown to be necessary to provide additional heat for such probes and to open-loop or close-loop control their temperature to obtain the most precise lambda signal possible.

Published German patent application 3,326,576 discloses that the probe, which here can have a probe ceramic having an NTC-characteristic, is directly subjected to an electrically alternating variable. The measured internal resistance of the probe ceramic is used for the temperature control of the exhaust gas probe.

A further method of heating an exhaust gas probe is for example disclosed in U.S. Pat. No. 4,294,679. Here, the exhaust gas probe is heated directly by a heater coil (PTC) mounted on the solid body electrolyte of the sensor. United States patent application Ser. No. 273,517, filed Jun. 15, 1981, discloses a method wherein a heater resistor (PTC), which is separated spatially from the exhaust gas probe, is used with an additional thermal element as a control sensor for controlling temperature.

U.S. Pat. No. 4,291,572 discloses a control of a heater of an exhaust gas probe in dependence upon the load of the engine. Furthermore, methods are also in use which utilize a deliberate increase of the exhaust gas temperature for heating the exhaust gas channel with the increase of exhaust gas temperature being caused by an intervention in the ignition and/or an intervention in the mixture. However, the above-mentioned methods are directed only to individual exhaust gas probes at least when they include control concepts. However, mixture control systems for internal combustion engines, which process the output signal of several probes, are also known. For example, U.S. Pat. No. 4,007,589 utilizes the signal of an exhaust gas probe which is mounted forward of the catalyzer as well as the signal of a second probe which is mounted rearward of the catalyzer for monitoring the catalyzer activity. The signal of the probe forward of the catalyzer is used for control.

United States patent application Ser. No. 679,050, filed May 9, 1991, discloses a method for lambda control wherein the signal of a probe mounted rearward of the catalyzer is utilized to change the actual value of a second probe utilized as a control sensor which is mounted forward of catalyzer. In addition to these methods, which include two exhaust gas probes lying one behind the other in the same exhaust gas flow, there are still further concepts for lambda control which make use of more than one probe. The so-called stereo lambda control is an example which is especially used for V-engines. Because of constructive characteristics, these engines have at least to some extent separate exhaust gas passages for the individual cylinder banks. In the context of the stereo lambda control, a separate mixture control system having its own lambda probe is provided for each cylinder bank. Since for the temperature characteristics of the exhaust gas probes which are used in multiprobe systems, the same laws apply as apply to individual systems, it is desirable also for these multiprobe systems to develop concepts for a targeted influencing of the exhaust gas temperature. As a result of such a concept, the measuring accuracy is improved with which the lambda signal is detected. A strictly open-loop control satisfies this purpose only incompletely because of its inability to respond to unanticipated disturbances. For example, disturbances in the ignition system can lead to an afterburning of the mixture in the exhaust gas channel. The temperature increase associated therewith is unnoticed by a pure open-loop control and can therefore lead to an overheating of the catalyzer and, in combination with the probe heater, lead to an undesired overheating of the probes. This disadvantage can be avoided with a temperature control loop for each individual probe. Such a solution has however the disadvantage that it is technically very complex and therefore also expensive.

SUMMARY OF THE INVENTION

The method and arrangement according to the invention for influencing the temperature of an exhaust gas probe affords the advantage with respect to the above methods that, on the one hand, even an unanticipated temperature influence can be compensated for and, on the other hand, the very considerable technical complexity associated with a temperature control of each individual probe can be avoided. In this way, the invention combines technical advantages of a temperature control for each individual probe with the advantage of a comparatively low cost which is associated with a pure temperature open-loop control.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
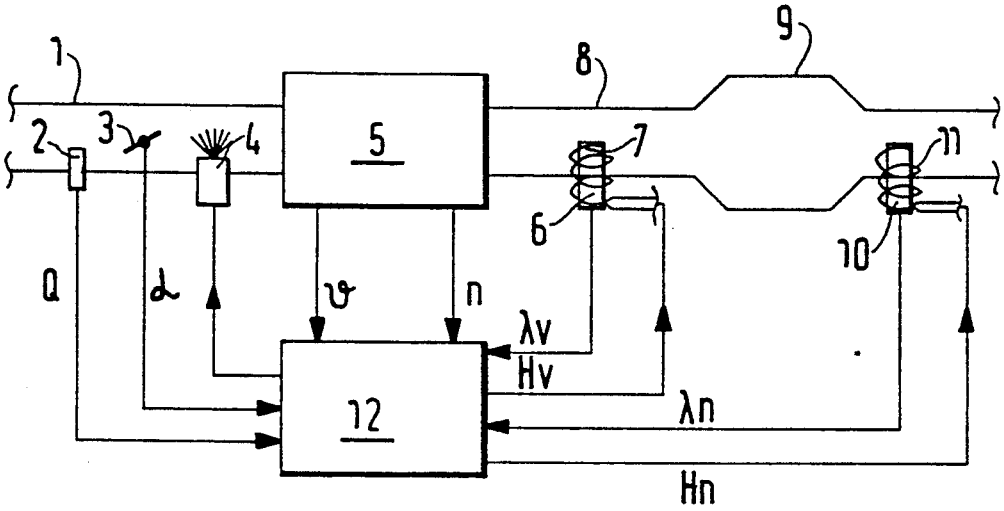
FIG. 1 is a schematic of a control loop for metering the mixture to an engine wherein a catalyzer is arranged downstream of the engine for treating the exhaust gas and heatable probes are disposed forward and rearward of the catalyzer.
Figure 2:
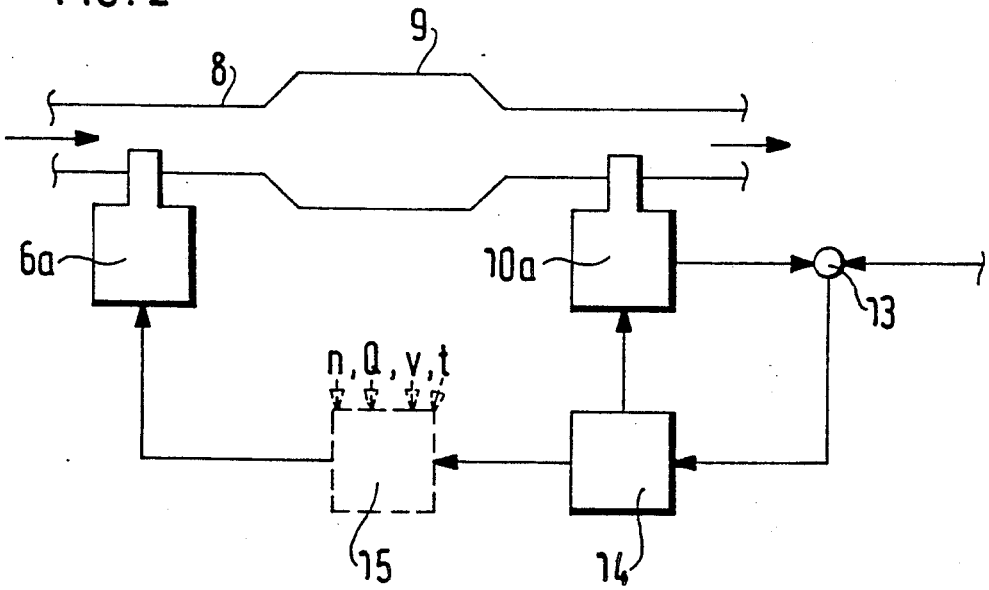
FIG. 2 is a schematic for use in explaining the method according to the invention for influencing the temperature of the exhaust gas probe for the embodiment shown in FIG. 1; and, FIG. 3 shows an embodiment of the invention for the case where two probes are mounted in different exhaust gas channels. Such an arrangement is often used in V-engines since in these engines, the exhaust gas of the separate cylinder banks are conducted away separately at least over some distances.

FIG. 1 shows a control loop for the metering of fuel for an internal combustion engine 5. An intake pipe 1 is connected to the input end of the engine and, in this input pipe 1, the following are mounted: a load sensor 2, a throttle flap 3 having a sensor (not shown) for the throttle flap position and an injection nozzle 4. An exhaust gas pipe 8 is connected to the output end of the engine and includes the following: two exhaust gas probes (6, 10) equipped with respective heaters (7, 11) of which one probe is mounted ahead of the catalyzer 9 and the other is mounted rearward of the catalyzer. A control unit 12 receives signals from the above-mentioned sensors for load Q and throttle flap position $\alpha$, signals $\lambda_v$ and $\lambda_h$ from the exhaust gas probes 6 and 10, respectively, as to the composition of the exhaust gas; signals which are characteristic of the temperature of the exhaust gas probes; and, signals from sensors (not shown) as to further factors influencing the formation of the mixture, such as cooling water temperature $\nu$ and engine speed (n). The outputs of the control unit 12 are connected to the heaters 7 and 11 as well as to the injection valve 4. The arrows in FIG. 2 show the directions of the flow of exhaust gas in the exhaust gas pipe 8.

Figure 3:
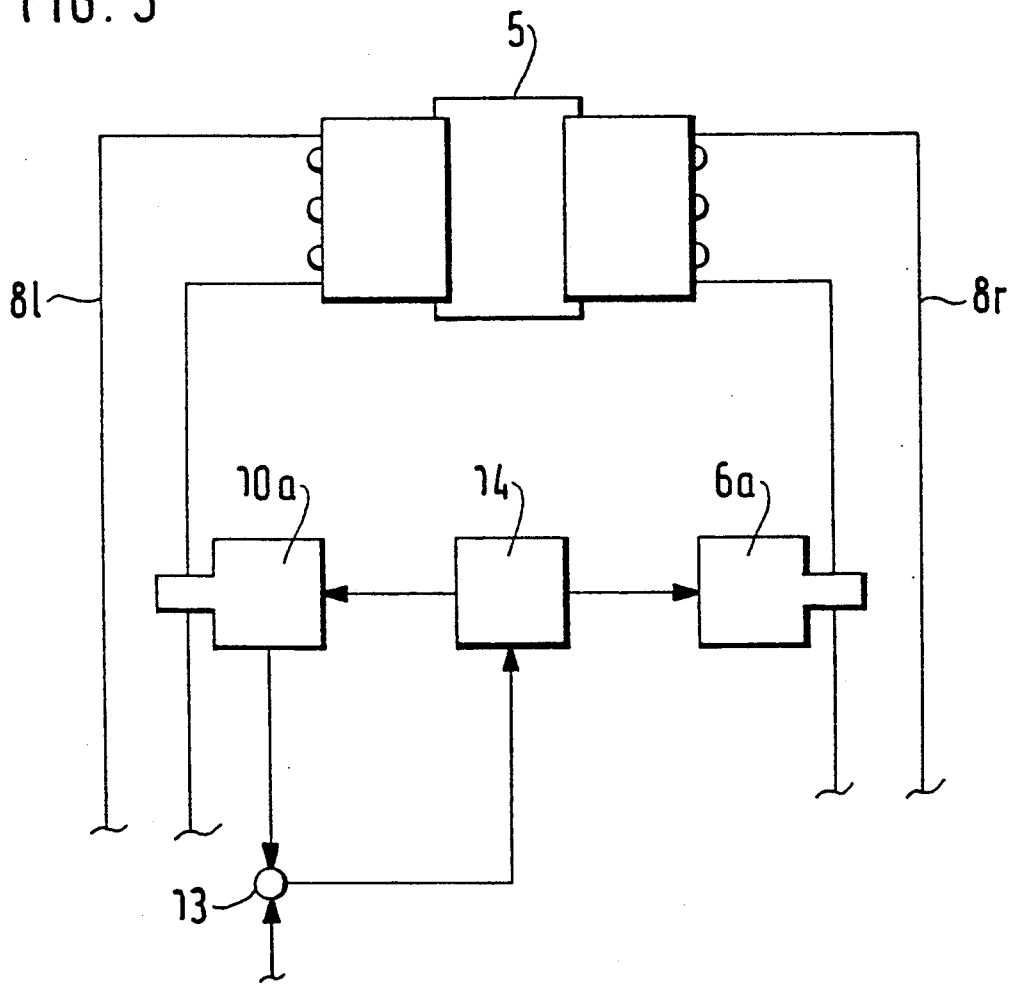

The block 10*a* represents the component comprising the exhaust gas probe 10 and the heater 11 corresponding thereto. An actual value characteristic of the temperature of block 10*a* as well as a corresponding desired value are both supplied to a comparator 13 with the actual value being provided for example by the internal resistance of the exhaust gas probe or the heater. The result of the comparison made in comparator 13 is supplied to a controller 14 having outputs which, in turn, are connected to the blocks 10*a* and 6*a*, respectively. In this context, block 6*a* represents the component unit comprising the exhaust gas probe 6 and the heater 7 corresponding thereto. The block 15 shown in phantom outline in FIG. 2 in the connection of blocks 14 and 6*a* represents an actuating variable manipulator. FIG. 3 shows a left exhaust gas tube 8L and a right exhaust gas tube 8R.

The operation of the control loop shown in FIG. 1 for the formation of the mixture of an internal combustion engine will now be described.

The air drawn in by suction through the intake pipe 1 is mixed with fuel from the injection valve 4 and burned in the engine 5. The exhaust gases developed therefrom are conducted through the exhaust pipe 8 into the catalyzer 9 wherein specific toxic components are oxidized or reduced. The residual oxygen content of the exhaust gas is detected by the exhaust gas probes 6 and 10 and conducted to the control unit 12 as a lambda-forward signal and a lambda-rearward signal. The exhaust gas probes 6 and 10 are equipped with heaters 7 and 11, respectively.

One task of this control unit 12 is to meter that quantity of fuel to the inducted air which, after the combustion, leads to a desired lambda value. To fulfill this task, the control unit 12, in addition to the lambda signals already mentioned, processes further signals such as: a signal as to the inducted air quantity Q from the load sensor 2 mounted in the intake pipe 1; a signal as to the opening angle $\alpha$ of the throttle flap 3; and, additional signals as to the cooling water temperature $\nu$ or the engine speed (n) which originate from sensors not shown.

Control systems of this kind for forming the mixture are well known and are used in large numbers in the assembly-line manufacture of motor vehicles. The description up to now is intended to describe the technical environment in which the advantages of the invention are realized.

A further task of the control unit 12 is to influence the heaters 7 and 11 of the exhaust gas probes 6 and 10, respectively, in such a manner that the temperature of the exhaust gas probes remains as constant as possible. In this connection, it is not necessary that the functions of the heater control and of the metering of the mixture are carried out by the same unit 12. Rather, these functions can be also carried out in separate components. The function according to the invention for influencing the temperature of both exhaust gas probes 6 and 10 is explained in greater detail in connection with FIG. 2.

As already mentioned, the arrows in the exhaust gas pipe 8 indicate the flow direction of the exhaust gas. The exhaust gas probe 10 mounted rearward of the catalyzer 9 has the heater 11. A variable characteristic for the temperature of the exhaust gas probe 10 can, for example, be provided by the direct current or alternating current resistance of the exhaust gas probe 10 or the corresponding heater 11 or by means of the measurement signal of a special temperature sensor not explicitly shown in the drawing. This variable is compared to a desired value in the comparator 13. The result of this comparison is supplied as a control deviation to a control unit 14 which supplies an actuating variable for influencing the heater. This actuating variable is ideally so configured that its effect leads to a reduction of the control deviation. The temperature of the exhaust gas probe 10 rearward of the catalyzer 9 is, accordingly, controlled in a closed control loop. In contrast, the temperature of the exhaust gas probe 6 ahead of the catalyzer 9 is simply open-loop controlled.

An essential feature of the invention is that the power supplied to a heater such as heater 7 is dependent upon the actuating variable of the temperature control of another probe, such as the heater 11, and, in this way, is taken along by the temperature control loop of the other heater. This is shown in FIG. 2 by the connection between the controller 14 and the block 6*a* which contains the second probe heater 7. It should here be noted that the essential feature of the invention is not exhausted in the details of the embodiment described; instead, with two heatable gas probes lying in the flow direction of the exhaust gas, the temperature of the forward heater can also be utilized for forming the control deviation which is a departure from the embodiment already described. Accordingly, in this embodiment, the heater of the rearward exhaust gas probe is controlled by the temperature control of the forward exhaust gas probe.

In the embodiment shown in FIG. 2, the actuating variable manipulator 15 shown in phantom outline compensates for a possible temperature gradient caused by the spatial separation of the two exhaust gas probes. This compensation can take place in dependence upon operating parameters such as engine speed (n), load Q, the cooling or lubricating temperature $\nu$ or also in dependence upon the time t which has elapsed since the engine was taken into service. Furthermore, it can be advantageous to delay switch-on of the heater of the exhaust gas probe mounted rearward of the catalyzer. The reason for this is related to the heating of the catalyzer by means of a heat exchange with the exhaust gases of the engine after a cold start. The cooling of the exhaust gases associated therewith can lead to the formation of water condensate. When the rearward probe, which is subjected to this water condensate, is heated from the start, the danger is present of damage by thermal shock to this exhaust gas probe. In contrast, the heater of the probe mounted forward of the catalyzer can already be switched on with the start of the engine.

FIG. 3 shows a further application of the method according to the invention. In this embodiment, the two blocks 6*a* and 10*a* represent component units comprising an exhaust gas probe and the heater corresponding thereto. In this embodiment, the blocks 6*a* and 10*a* are no longer mounted one behind the other in the same exhaust gas flow; instead, they are disposed in separate exhaust gas lines 8L and 8R such as in the case of a V-engine. The heater of the one exhaust gas probe forms a closed control loop with the controller 14 and the comparator 13 while the heater of the other probe is controlled in a control loop in dependence upon the actuating variable. This constellation too contains the feature of the invention according to which the temperature control of the one exhaust gas probe is controlled by the temperature control of the other exhaust gas probe.

In the special case of the stereo lambda control, the possibility is further provided that the temperature in the two separate exhaust gas chains can be influenced individually via a change of the exhaust gas temperature. Exhaust gas temperature changes can, as is known, be caused by the following: by manipulating the ignition time point, a deliberate change of mixture and also by means of a combination of the above-mentioned measures. In the context of a stereo lambda control, as mentioned, a separate mixture control system having its own lambda probe is provided for each cylinder bank. With this precondition, a control loop for influencing the exhaust gas temperature can, for example, operate such that, when the temperature of the exhaust gas in the exhaust gas channel of one cylinder bank deviates from a desired value, changes in the composition of the mixture which is supplied to this cylinder bank can be made. These changes effect a change of the exhaust gas temperature and therefore a change of the heat energy which is supplied to the exhaust gas probe. The essential feature of the invention is that with respect to influencing temperature, changes made in the mixture composition for the one cylinder bank are made in the mixture composition for the other cylinder bank. These effects can be obtained when, in a manner analogous to the method described for the mixture composition, the quantity of mixture or the ignition time point is influenced.

The transfer of the concept of the invention from the embodiments described herein to the application possibilities outlined herein provide no difficulties to those skilled in the area of engine controls. It is also noted that the invention is not limited to these applications and that the temperature control of only one exhaust gas probe is carried along by the temperature control of the other exhaust gas probe. Rather, the cost advantage of the method of the invention increases with the number of exhaust gas probes controlled by one exhaust gas probe. Such a case can, for example, occur in the context of a mixture control for a V-engine which includes an exhaust gas channel for each of the two cylinder banks and wherein each exhaust gas channel has a separate catalyzer with an exhaust gas probe mounted forward of the catalyzer and an exhaust gas probe mounted rearward of the catalyzer.

The embodiment of the temperature closed-loop and open-loop control system of these four probes can be so configured that the heaters of three exhaust gas probes are controlled by the fourth exhaust gas probe. The concept of the invention can be viewed such that from the total of N exhaust gas probes, which can be heated by at least one of the methods and arrangements described above, any number of desired groups can be formed in which a temperature control method is carried out for one element of the group having an actuating variable used as the output value for the temperature control of the other elements (exhaust gas probes) of the group. In this connection, attention is directed to a so-called individual cylinder control wherein what has been described for the various cylinder banks of a V-engine can be transferred to individual cylinders. For example, in a six cylinder engine wherein an exhaust gas probe is provided for each cylinder, the temperature open-loop controls of five exhaust gas probes can be coupled to the temperature closed-loop control of the remaining exhaust gas probe. It is here also possible that the six exhaust gas probes can be grouped into two groups with each group including three exhaust gas probes wherein the temperature open-loop control of two elements of a group is controlled by the temperature closed-loop control of the third element of the group.

It is understood that the foregoing description is that of the preferred embodiments of the invention and that various changes and modifications may be made thereto without departing from the spirit and scope of the invention as defined in the appended claims.

What is claimed is:

1. A method of controlling the temperature of a plurality of exhaust gas probes for an internal combustion engine, the method comprising the steps of:

controlling the temperature of at least a first exhaust gas probe in a closed control loop wherein an actuating variable is generated for influencing the temperature of said first exhaust gas probe; and, coupling a temperature open control loop of at least a second one of said probes to said closed control loop so as to use said actuating variable as a start value for said temperature open control loop.

2. The method of claim 1, wherein the first and second exhaust gas probes have first and second heating elements, respectively; said first heating element is connected into said closed control loop and said second heating element is connected into said open control loop; and, wherein an approximately equal heat energy is supplied to said first and second heating elements in response to a control deviation in said closed control loop.

3. The method of claim 1, wherein the first and second exhaust gas probes have first and second heating elements, respectively; said first heating element is connected into said closed control loop and said second heating element is connected into said open control loop; and, wherein different heat energies are supplied to said first and second heating elements in response to a control deviation in said closed control loop.

4. The method of claim 3, wherein the first and second exhaust gas probes have first and second heating elements, respectively; said first heating element is connected into said closed control loop and said second heating element is connected into said open control loop; and, wherein the difference amount of heat energy is controlled in dependence upon operating parameters of the engine such as engine speed, load, temperature of the lubricant or coolant or the time which has elapsed since the engine has been taken into service.

5. The method of claim 4, wherein said first and second exhaust gas probes are arranged forward and rearward of a catalyzer; and, wherein said second heating element is switched on in a time delayed manner relative to said first heating element.

6. The method of claim 1, wherein said first and second exhaust gas probes are arranged forward and rearward of a catalyzer; and, wherein the temperature of the rearward exhaust gas sensor is used as a control variable.

7. The method of claim 1, wherein the engine has two cylinders having respective discharge channels and said first and second exhaust gas probes are mounted in corresponding ones of said discharge channels.

8. The method of claim 7, wherein individual cylinders of the engine have ignition and mixture-forming systems; wherein exhaust gas temperature changes are effected by a manipulation of the mixture and ignition; and, wherein the temperature of the exhaust gas probes is controlled by said exhaust gas temperature.

9. An arrangement for controlling the temperature of a plurality of exhaust gas probes for an internal combustion engine, the arrangement comprising:

a first heating element for heating a first one of said probes;

a second heating element for heating a second one of said probes;

measuring means for measuring a variable characteristic for the temperature of the first probe;

comparison means for comparing said variable to a desired value to produce a difference signal;

a controller connected to said first heating element for controlling the temperature thereof in dependence upon said difference signal; and, said controller being connected to said second heating element for open-loop controlling said second heating element in dependence upon said difference signal.

10. The arrangement of claim 9, further comprising means for increasing or decreasing the heat energy supplied to said exhaust gas probes.

11. The arrangement of claim 10, wherein said measuring means includes means for measuring the internal resistance of the first probe for determining the temperature of the first exhaust gas probe.

* * * * *